US005813670A

United States Patent [19]

Maass

[11] Patent Number: 5,813,670

[45] Date of Patent: Sep. 29, 1998

[54] DEVICE AND METHOD FOR RECEIVING, AND FOR LIFTING AND LOWERING A LATERALLY ALIGNABLE PILE BOARD

[75] Inventor: Burkhard Maass, Heidelberg, Germany

[73] Assignee: Heidelberger Druckmaschinen AG, Heidelberg, Germany

[21] Appl. No.: 927,838

[22] Filed: Aug. 10, 1992

[30] Foreign Application Priority Data

Aug. 10, 1991 [DE] Germany ..... 41 26 542.4

[51] Int. Cl.[6] ..... B65H 1/26

[52] U.S. Cl. ..... 271/157; 271/158

[58] Field of Search ..... 271/147, 157, 271/158

[56] References Cited

U.S. PATENT DOCUMENTS

| | | | |
|---|---|---|---|
| 2,094,826 | 10/1937 | Seybold | 271/158 |
| 2,218,401 | 10/1940 | Martin | 271/157 |
| 2,368,094 | 1/1945 | Baker et al. | 271/157 |
| 2,900,186 | 8/1959 | Schwebel | 271/158 |
| 3,104,100 | 9/1963 | Watts et al. | 271/157 |
| 3,998,448 | 12/1976 | Gray et al. . | |
| 4,153,242 | 5/1979 | Mizuma | 271/157 |
| 4,418,907 | 12/1983 | Shultz et al. | 271/157 |

FOREIGN PATENT DOCUMENTS

| | | | |
|---|---|---|---|
| 871158 | 3/1953 | Germany . | |
| 1015012 | 9/1957 | Germany . | |
| 1910160 | 10/1969 | Germany . | |
| 176229 | 7/1988 | Japan | 271/157 |
| 1248539 | 10/1971 | United Kingdom . | |

*Primary Examiner*—David H. Bollinger
*Attorney, Agent, or Firm*—Herbert L. Lerner; Laurence A. Greenberg

[57] ABSTRACT

A pile board receiver of a pile lifting device comprising pivotal entrainer hooks having respective pivot points from which the entrainer hooks extend downwardly, the entrainer hooks being vertically guidable and being pivotable in a direction towards a location at which a pile board is receivable in the receiver, each of the entrainer hooks having a hook opening disposed below the respective pivot point and directed towards the location, the respective pivot point being located beyond the location; each of the hooks being formed with a respective prong extending into a region of the receiver wherein a pile board receivable in the receiver is liftable therein; and the method thereof.

9 Claims, 5 Drawing Sheets

DEVICE AND METHOD FOR RECEIVING, AND FOR LIFTING AND LOWERING A LATERALLY ALIGNABLE PILE BOARD

SPECIFICATION

The invention relates to a pile lifting device, a pile board receiver in the pile lifting device, a pile feeder, and a method for receiving and for lifting/lowering a laterally alignable pile board.

German Published, Non-Examined Patent Application DE-OS 19 10 160 discloses a pile feeder for sheets of paper in sheet-fed printing presses, wherein a pile board is carried upward to a separating or singling unit by lifting chains. The pile board can be displaced laterally. This publication teaches the use of guided pivot levers which are entrained by the lifting chains and are coupled to one another by means of a shaft. To receive the next pre-stacked pile, the coupled pivot levers slip downwardly along guide strips, after being decoupled from the lifting chains. The coupled pivot levers have rollers supported thereon with which the pivot levers strike an edge of the pile board and tilt upwardly and away with a swiveling motion. The coupled pivot levers move past the board surface and drop back into the starting position thereof again with a swiveling motion. They slip farther downwards to engage stops below the feed table, so as to become engaged and lifted again by the lifting chains.

The movement past the level of the pile board can be severely impaired, in the heretofore disclosed coupled pivot lever system, due to the coupling and due to the repeated striking of the levers against the pile board like a bouncing ball. In fast-feeding machines, an undesired feeling of untrustworthiness with respect to the reliability of the pile receiving and feeding operations can occur during pile changing.

To be capable of tilting back again under their own weight, the levers, which have been tilted away upwardly, require a low-lying center of gravity located below the pile board, in the entraining position of the latter. The chain drive of the pivot point for such a feed pile must extend far downwardly in order to receive pile boards. Pile boards having low height cannot be received without some additional effort. Even if the floor of the pressroom is lowered, additional effort or expense is necessary. For a fairly satisfactory reliability of the return tilting or pivoting of the levers, the pivot point of the levers is additionally required to be laterally spaced from the edge of the pile board, which results in a loss of space on the side thereof.

It is accordingly an object of the invention to provide a device and a method for reliably receiving and entraining a pile board with optimal utilization of space.

With the foregoing and other objects in view, there is provided, in accordance with the invention, a pile board receiver of a pile lifting device comprising pivotal entrainer hooks having respective pivot points from which the entrainer hooks extend downwardly, the entrainer hooks being vertically guidable and being pivotable in a direction towards a location at which a pile board is receivable in the receiver, each of the entrainer hooks having a hook opening disposed below the respective pivot point and directed towards the location, the respective pivot point being located beyond the location; each of the hooks being formed with a respective prong extending into a region of the receiver wherein a pile board receivable in the receiver is liftable therein.

For receiving the novel pile board, the downwardly guided entrainer hooks in vicinity of the pile board are pivoted laterally outwardly by the pile board and resume the original or starting position thereof again underneath the pile board in order to entrain the pile boards with the prongs of the hooks as the hooks move upwardly. The pivotable entrainer hooks have a pivot point above the position of contact of the pile board therewith in the entraining position, so that even low pile boards, as well as pile boards with a lowered pressroom floor, can be received simply and reliably.

The pivot point may be located quite close to the edge of the pile boards, so that the lateral space is optimally utilized. The entrainer hooks also permit simple lateral alignment of the pile board.

In accordance with another feature of the invention, the pile board receiver includes respective carriages mounted in the receiver for pivotally carrying the entrainer hooks, means for lifting and lowering the carriages in the receiver in a direction parallel to a direction in which a pile board receivable in the receiver is liftable therein.

In accordance with a further feature of the invention, two entrainer hooks are pivotably connected to each of the carriages, the means for lifting and lowering the carriages including guide strips for guiding the respective carriages, and lifting and lowering chains drivingly connectible to the carriages.

The foregoing last two features are of great importance with respect to the reliable functioning of the pile board receiver. Exact guidance of the downward motion of the entrainer hooks, as well, improves the reliability, particularly, for high-speed machines.

In accordance with an added feature of the invention, there are provided force storage means operatively connected to the entrainer hooks.

The force storage means afford reliable entrainment of the pile board even with relatively small, lightweight entrainer hooks. An especially simple and economical embodiment is provided, in accordance with an additional feature of the invention, whereby the force storage means comprise a compression spring bearing at one end thereof on the respective entrainer hook, and at the other end thereof on the respective carriage.

In accordance with another aspect of the invention, there are provided entrainer hooks pivotable in a direction towards a pile board for picking up the pile board, the entrainer hooks having respective pivot points located at a distance from the pile board, and respective hook openings directed towards the pile board; and lifting and lowering means for the entrainer hooks including guide means for guiding the entrainer hooks parallel to a direction in which the pile board is liftable, the entrainer hooks being formed with respective prongs extending into a region wherein the pile board is liftable.

A secure, reliable receipt and entrainment of pile boards is provided by the foregoing embodiment of the invention.

In accordance with yet a further feature of the invention, the lifting and lowering means comprise lifting and lowering chains, and carriages fastened to the chains, the guide means comprising guide strips continuously engageable by the carriages, the entrainer hooks being pivotably suspended from the guide strips; and including force storing means operatively connected to the entrainer hooks.

In accordance with yet another aspect of the invention, a pile feeder is provided comprising guide chains, entrainer hooks guidable by the chains for receiving a pile board, each of the entrainer hooks having a hook opening directed towards a location a t which the pile board is receivable by the entrainer hooks, each of the entrainer hooks being formed with a prong extending into a region wherein the side board is liftable in a given direction, and guide means for guiding the entrainer hooks parallel to the pile-board lifting direction.

In accordance with another feature of the invention, there are provided carriages secured to the chains and liftable and lowerable thereby, guide strips in continuous contact with the carriages, entrainer hooks pivotably suspended from the carriages, and force storing means carried by the carriages and operatively connected to the entrainer hooks.

In accordance with a further aspect of the invention, there is provided a method for receiving and for lifting/lowering a laterally alignable pile board, which comprises guiding a device or means for receiving a pile board on chains from above the pile board to below the pile board; disposing the pile board and the receiving means so that, at the level of the pile board, the pile board deflects the receiving means laterally out of the position thereof and, below the pile boards, the receiving means resume their original position; lifting the receiving means by the chains again, so that the receiving means automatically engage and lift the pile board.

In accordance with yet an additional aspect of the invention, there is provided an assembly, comprising, in combination, a laterally adjustable paper sheet feeder having a pre-stacking operational mode, and a pile lifting device, comprising a pile board receiver including pivotal entrainer hooks having respective pivot points from which the entrainer hooks extend downwardly, the entrainer hooks being vertically guidable and being pivotable in a direction towards a location at which a pile board is receivable in the receiver, each of the entrainer hooks having a hook opening disposed below the respective pivot point and directed towards the location, the respective pivot point being located beyond the location; each of the hooks being formed with a respective prong extending into a region of the receiver wherein a pile board receivable in the receiver is liftable therein.

In accordance with a concomitant aspect of the invention, there is provided, in a method of operating an assembly of a laterally adjustable paper sheet feeder in a pre-stacking operational mode thereof, and a pile lifting device having a pile board receiver, a procedure which comprises receiving and lifting/lowering a laterally alignable pile board, which include guiding means for receiving a pile board on chains from above the pile board to below the pile board; disposing the pile board and the receiving means so that, at the level of the pile board, the pile board deflects the receiving means laterally out of the position thereof and, below the pile board, the receiving means resume their original position; lifting the receiving means by the chains again, so that the receiving means automatically engage and lift the pile board.

Rapid and reliable pile exchanged with optional space utilization, even for relatively low-lying pile boards, are thus achievable. Moreover, the entrainment of the pile boards, even when employed with multiple printing passes, permit lateral adjustability of the received pile boards.

Other features which are considered as characteristic for the invention are set forth in the appended claims.

Although the invention is illustrated and described herein as embodied in a device and method for receiving, and for lifting and lowering a laterally alignable pile board, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
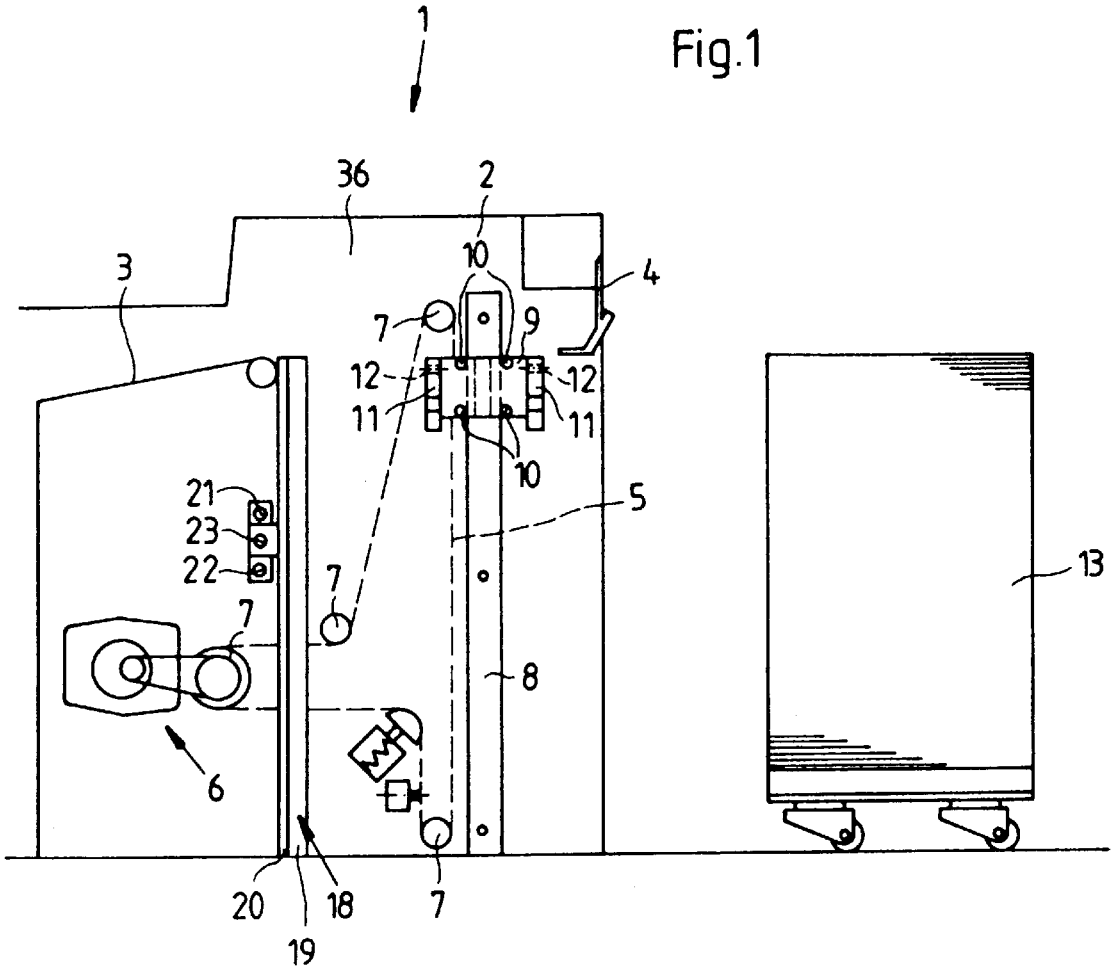
FIG. 1, is a diagrammatic side elevational view of a paper sheet pile feeder for a sheet-fed offset printing press, in accordance with the invention, prior to introducing a sheet pile therein.
Figure 2:
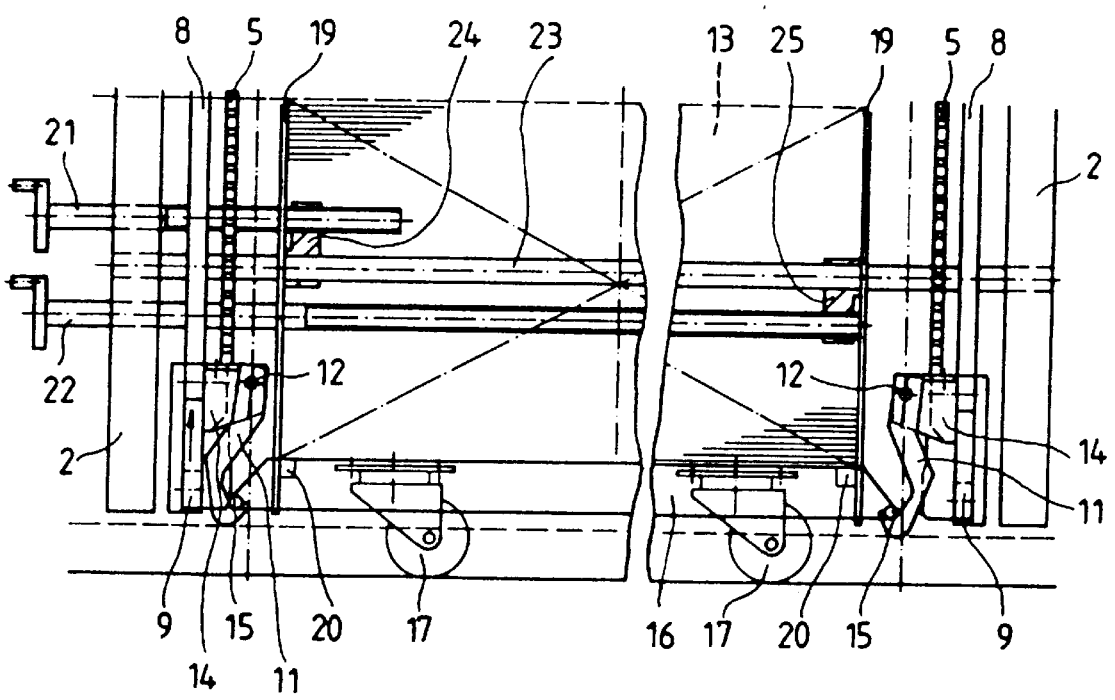
FIG. 2 is a partly broken-away front elevational view of the paper pile feeder with a paper sheet pile received therein, and with a diagrammatically illustrated device for lateral alignment thereof.

Referring now to the drawings and first, particularly to FIG. 1 thereof, there is shown a sheet pile feeder 1, for example, of a sheet-fed rotary offset printing press. A pile region 36, into which a feed pile 13 formed of stacked paper sheets is inserted, is defined by inner surfaces of two opposite side walls 2, only one of which is visible in FIG. 1. With the aid of a conventional suction feeding unit 4, for example, the sheets of paper are fed from the feed pile 13 to conventional conveyor means on a feed table 3. The feed pile 13 is carried vertically upwards by lifting and lowering chains 5, which are driven via a drive unit 6 and guided around sprocket wheels 7, to where the paper sheets of the pile 13 are removed.

Figure 3:
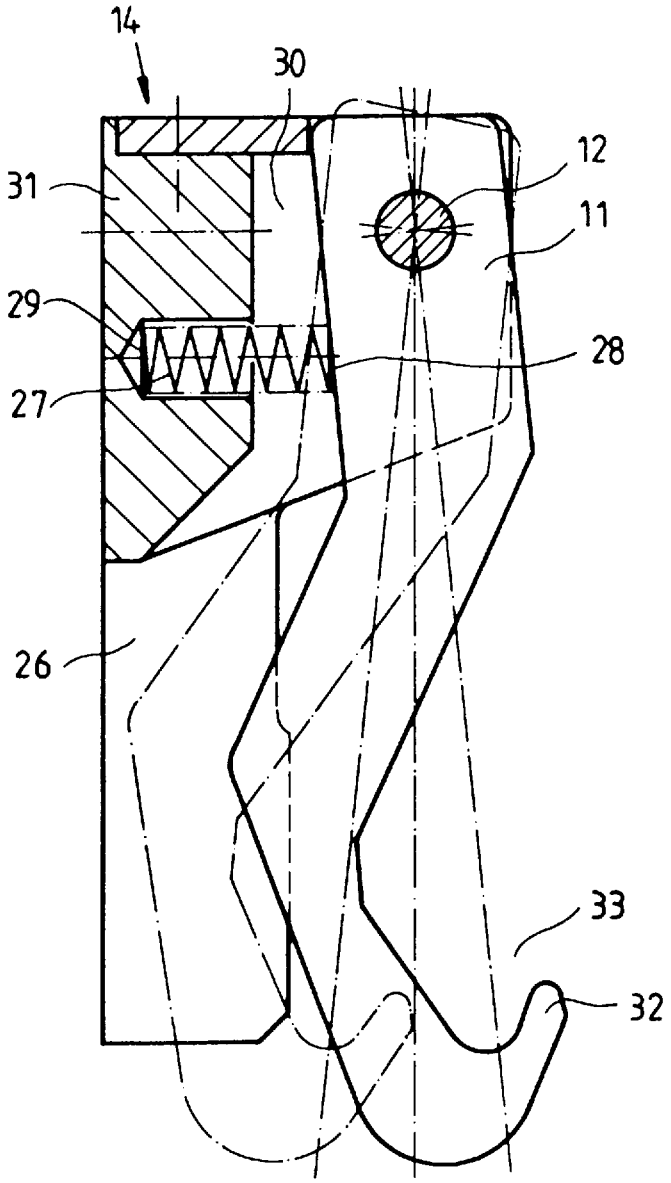
FIG. 3 is an enlarged fragmentary view of FIG. 2 showing, in greater detail, a coupling hook according to the invention.

A respective guide strip 8 is fastened to the respective inner surfaces of the two side walls 2 in the pile region 36 so as to be aligned parallel to the pile feed direction. A respective guide carriage 9 with rollers 10 engaging in grooves formed in the guide strips 8 is displaceably supported on each guide strip 8, each of the guide carriages 9 carrying two downwardly directed, pivotable entrainer hooks 11. As can be seen in FIGS. 2 to 6, a bearing block 14 for carrying the entrainer hooks 11, is secured to the guide carriage 9, so as to face towards the feed pile, the bearing block 14 being formed of a traverse member or crosstie rod 31 and two bearing walls 30, one of which is shown in FIG. 3, which are secured to both sides thereof. The entrainer hook 11 is pivotably supported by a pivot pin 12 between the two bearing walls 30, so as to be swingable from the traverse member 31 to the part of the bearing block 14 facing towards the feed pile 13. The entrainer hook 11 is provided with a curvature so that an entraining prong 32 thereof and an open region 33 of the hook are directed towards the middle of the pile feeder 2 and thus towards the feed pile 13 when this pile 13 has been introduced into the feeder 2. A free space 26 adequate for accommodating the pivoting or swiveling movements of the pivoting entrainer hook 11 is provided between the bearing walls 30 and below the traverse member 31. Under the pivot pin 12 and between the traverse member 31 and the pivotal entrainer hooks 11, a compression spring 27 is provided, which is braced against spring bearings 28 and 29, respectively, on the pivoting hook 11 and on the traverse member 31.

Between the side walls 2, conventional lay strips 18 having a lay edge 20 engageable by the leading edge of the sheets in the feed pile 13 and having a side or lateral edge 19 for lateral contact with the sheets in a plane parallel to the pile feeding direction are provided for the feed pile 13. As is apparent in FIG. 2, the lateral lay edges 19 are laterally adjustable. The lateral lay edges 19 are provided for such a purpose with guide blocks 24 and 25, which are slidingly mounted on a shaft 23 fastened in the side walls 2 and oriented transversely to the sheet transport or feeding direction. Spindles 21 and 22, which are rotatably mounted in one of the side walls 2 yet fixed against displacement in axial direction thereof, are formed with respective threads with which they engage in threaded bores formed in the respective guide blocks 24 and 25. By rotating the threaded spindles 21 and 22, by means of a handwheel, as illustrated, for example, the position of the lateral stops or lay edges 19 of the lay strips 18 can be adjusted.

Figure 6A:
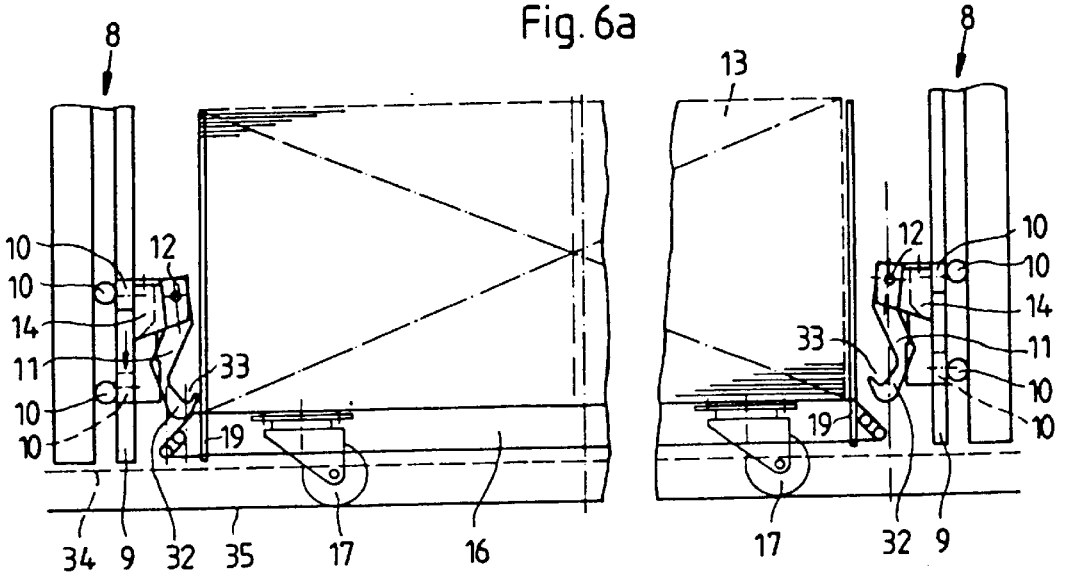
FIGS. 6*a, b* and *c,* are views like that of FIG. 5 showing a previously inserted sheet pile board in various phases of the receipt thereof by the sheet feeder.
Figure 6B:
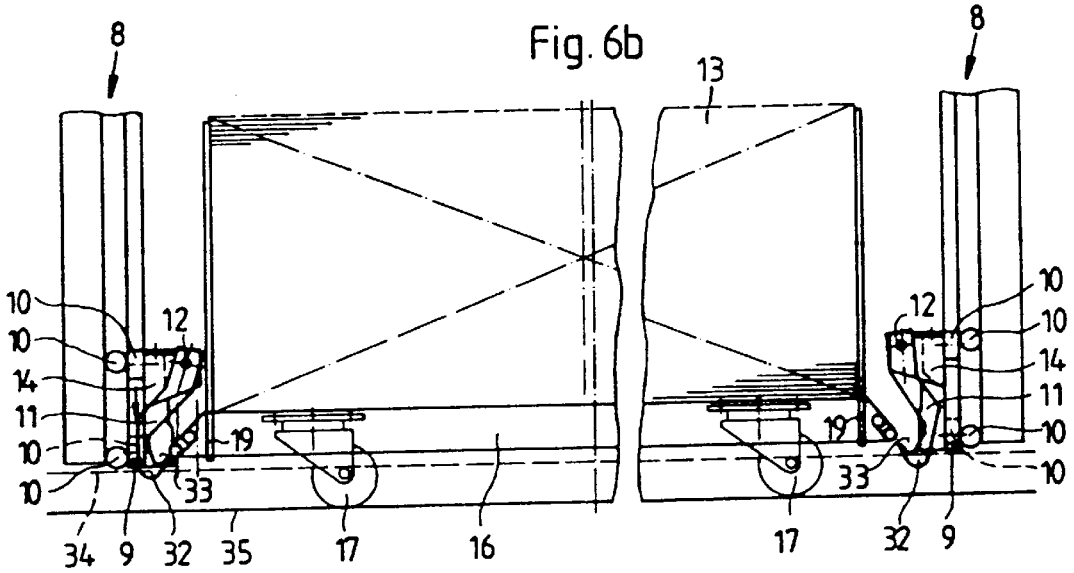
Figure 6C:
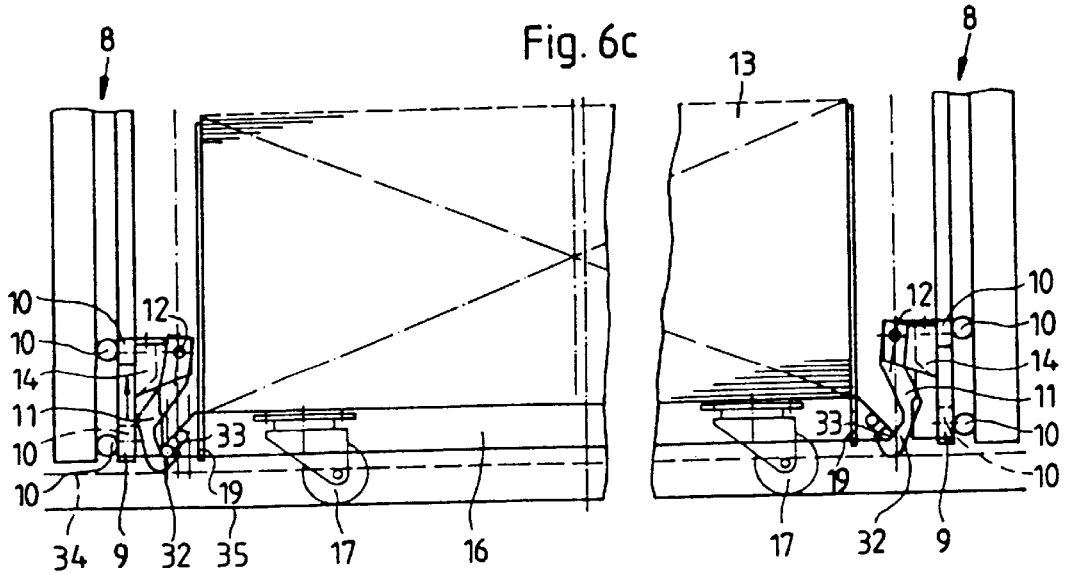

The feed pile 13 which is to be processed is pushed into the pile region 36 of the pile feeder 1, so that the leading edge of the sheets in the feed pile 13 rest against the front lay edges 20. With the aid of the threaded spindles 21 and 22, the lateral lay edges 19 of the lay strips 19 are brought into contact with the side edges of the sheets forming the feed pile 13. The feed pile 13 can also be displaced into a desired lateral working position thereby. With the aid of the respective lifting and lowering chain 5, to which the corresponding guide carriages 9 are secured, the latter, as can be seen in FIG. 6*a;* may be lowered. When the hook prongs 32 reach the level of the pile board 16, a front region of the hook prongs 32 is engaged by the pile board 16 and, because the curvature of the hooks 32, at the point of contact thereof with the pile board 16, has a desirable tangent extending upwardly towards the middle of the sheet pile, the hook prongs 32 are pivoted back laterally in a direction towards the guide strip 8 and opposite to the force of the compression spring 27, as shown in FIG. 6*b*. If the hook prongs 32 are located below the feed table 3, they are returned on the starting position thereof by the spring force of the spring 27. The guide carriages 9 can then be raised by the lifting chains 5, as shown in FIG. 6*c*. In this regard, they engage behind retaining pins 15 fastened to the pile board and thus entrain the feed pile 13 upwardly in the direction of the suction feeding unit 4. A pile lifting device of this type permits relatively simple pre-piling. Empty pile boards can simply be removed by hand from the entrainer hooks 11 which hold the pile boards 16, while the guide carriage 9 remains in the raised position thereof. Thereafter, the guide carriages 9 are lowered to the new feed pile 13 which has been previously inserted into the feed strips 18, which remain in their previous setting, in order to receive the feed pile 13 directly for feeding. In this process, the hooks 11 also permit desired lateral variations in position after the reception of the feed pile 13, as can be seen from FIG. 2.

Figure 4:
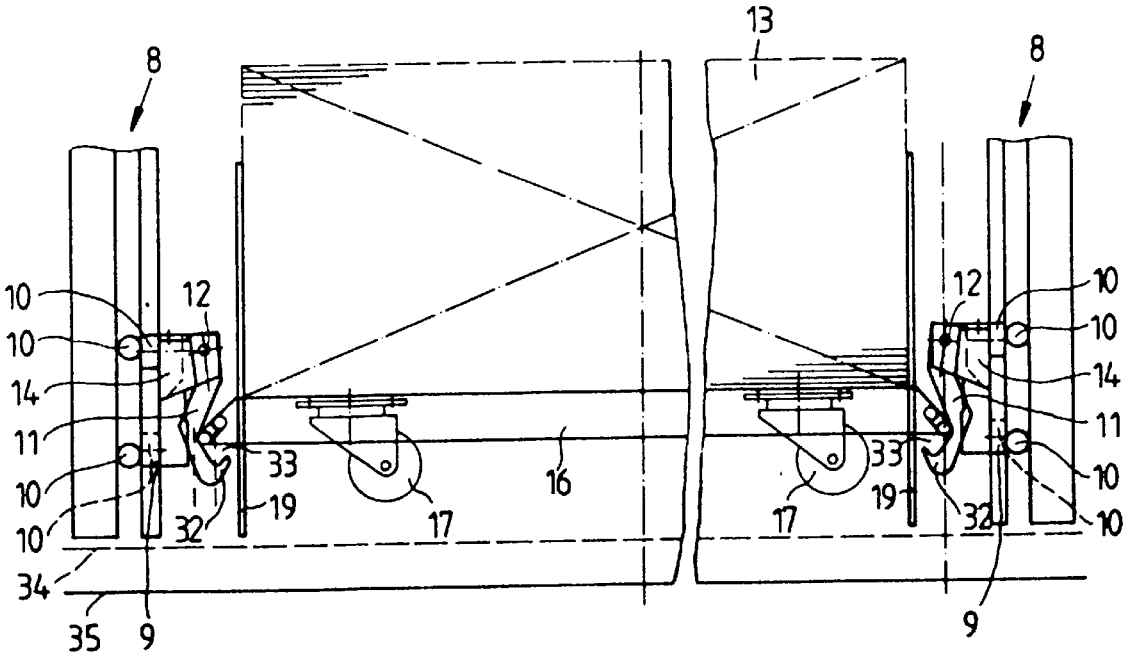
FIG.4 is a view like that of FIG. 2 showing another operating phase of the sheet feeder wherein a pile board has been inserted into the feeder without touching the floor.
Figure 5:
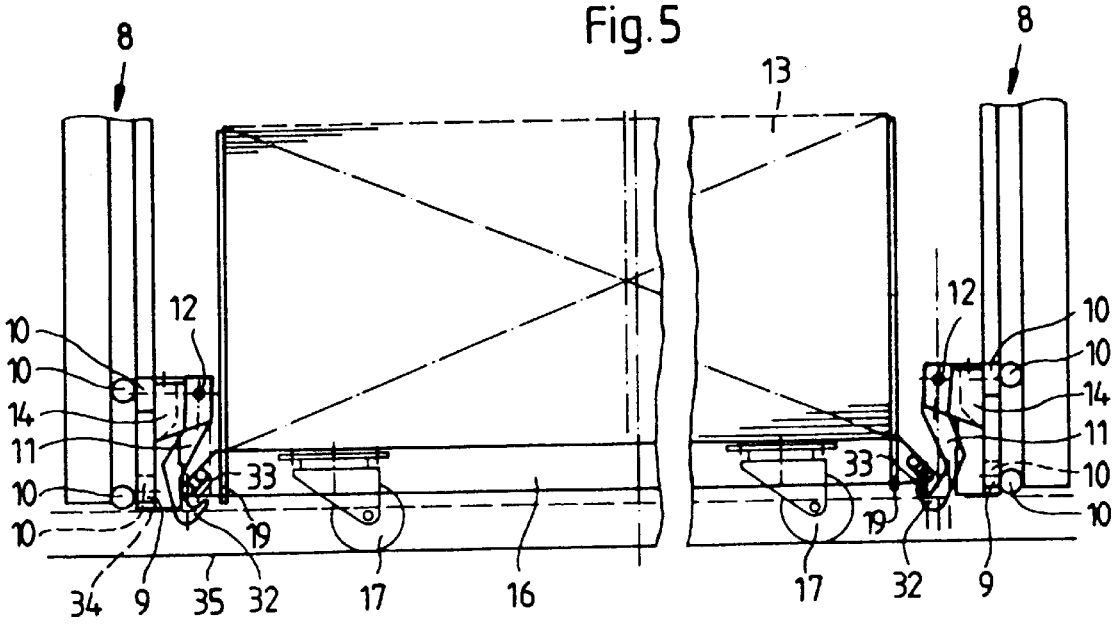
FIG. 5, is another view like that of FIG. 4 in yet another operating phase wherein coupling hooks are in a lowermost position thereat, and the pile board is retracted to a lowered pressroom floor.

A new feed pile 13 can be inserted, for example, by hand, even without having the feed pile rollers 17 come into contact with the floor 35, as is apparent from FIG. 4. FIG. 5 shows reception of the feed pile 13, when the floor 35 of the pressroom is lowered below a normal floor level 34. Due to a desired guidance and suspension of the hook 11 so that its pivot point 12 is in the vicinity of the pile edge, and due to the orientation of the pivot arm which extends downwardly a relatively great distance from the pivot point 12 to a receiving or take-up point on the hook prong 32, substantially parallel to the feeding direction, almost the entire space between the respective pivot points 12 of both hooks 11 can be utilized for the allowable format width of the paper sheets, and low-lying pile boards can be received or picked up without difficulty.

The foregoing is a description corresponding in substance to German Application P 41 26 542.4, dated Aug. 10, 1991, the International priority of which is being claimed for the instant application, and which is hereby made part of this application. Any material discrepancies between the foregoing specification and the aforementioned corresponding German application are to be resolved in favor of the latter.

I claim:

1. A pile board receiver of a pile lifting device for lifting a feed pile disposed on a pile board comprising pivotal entrainer hooks having respective pivot points from which said entrainer hooks extend downwardly, means for vertically guiding said entrainer hooks, said entrainer hooks being pivotable in direction towards and away from a defined location in said receiver at which a pile board is receivable in said receiver, each of said entrainer hooks having a hook opening disposed below the respective pivot point and directed towards said location, the respective pivot point being located outside said defined location as extended vertically upward; each of said hooks being formed with a respective prong extending into a region of said receiver wherein a pile board receivable in said receiver is liftable therein, and wherein each entrainer hook has a curvature of the hook at the point of contact with said pile board, the curvature having a tangent extending upwards toward the middle of the sheet pile for urging said prong of the entrainer hook away from said defined location during downward movement of said entrainer hook.

2. Pile board receiver according to claim 1, including respective carriages mounted in said receiver for pivotally carrying said entrainer hooks, means for lifting and lowering said carriages in said receiver in a direction parallel to a direction in which a pile board receivable in said receiver is liftable therein.

3. Pile board receiver according to claim 2, wherein two entrainer hooks are pivotably connected to each of said carriages, said means for lifting and lowering said carriages including guide strips for guiding the respective carriages, and lifting and lowering chains drivingly connectible to said carriages.

4. Pile board receiver according to claim 3, including force storage means operatively connected to said entrainer hooks.

5. Pile board receiver according to claim 4, wherein said force storage means comprise a compression spring bearing at one end thereof on the respective entrainer hook, and at the other end thereof on the respective carriage.

6. A pile lifting device for lifting a pile of sheets disposed on a pile board having outer edges, comprising entrainer hooks pivotable in a direction towards and away from a pile board for picking up the pile board, said entrainer hooks having respective pivot points located horizontally at a distance from an imaginary vertical extension of the outer edges of the pile board, and respective hook openings directed towards the pile board; lifting and lowering means for the entrainer hooks including guide means for guiding the entrainer hooks parallel to a direction in which the pile board is liftable, said entrainer hooks being formed with respective prongs extending into a region wherein the pile board is liftable and wherein each entrainer hook has a curvature of the hook at the point of contact with said pile board, the curvature having a tangent extending upward toward the middle of the sheet pile for urging said hook away from said imaginary vertical extension during downward movement of said hook.

7. In a method of operating an assembly of a laterally adjustable paper sheet feeder in a pre-stacking operational mode thereof, and a pile lifting device having a pile board receiver, the procedure which comprises receiving and lifting/lowering a laterally alignable pile board, which includes pivotal receiving means being pivotal in direction toward and away from the pile board for receiving a pile board on chains from above the pile board to below the pile board wherein said receiving means have a curvature at a point of contact with the pile board, the curvature having a tangent extending upward in direction of the pile board for urging said receiving means away from the pile board during lowering of the receiving means; disposing the pile board and the receiving means so that, at the level of the pile board, the pile board deflects the receiving means laterally away from the pile board and, below the pile boards, the receiving means resume their original position; lifting the receiving means by the chains again, so that the receiving means automatically engage and lift the pile board.

8. A pile board receiver comprising, in combination. a laterally adjustable paper sheet feeder having a pre-stacking operational mode, and a pile lifting device, comprising a pile board receiver including pivotal entrainer hooks having respective pivot points from which said entrainer hooks extend downwardly, said entrainer hooks being vertically guidable and being pivotable in a direction towards a location at which a pile board is receivable in said receiver, each of said entrainer hooks having a hook opening disposed below the respective pivot point and directed towards said location, the respective pivot point being located outside said location; each of said hooks being formed with a respective prong extending into a region of said receiver wherein a pile board receivable in said receiver is liftable therein, wherein said pile board has an upper surface, and two opposite ends, wherein said upper surface has a downward slant at each of said ends, wherein said slant is operative for deflecting a respective entrainer hook as the entrainer hook extends downward past said pile board.

9.A pile board receiver according to claim 8, including a plurality of retaining pins in said pile board, each of said retaining pins aligned with a respective one of said entrainer hooks and operative for entering said open region of said entrainer hook.

* * * * *